US007402125B2

(12) United States Patent
Wang

(10) Patent No.: US 7,402,125 B2
(45) Date of Patent: Jul. 22, 2008

(54) ELECTRONIC CONSOLE WITH A SYSTEM FOR INDICATING THE MOTION POWER

(76) Inventor: Leao Wang, No. 1, Lane 233, Sec. 2, Charng Long Road, Taiping (TW) 411

( * ) Notice: Subject to any disclaimer, the term of this patent is extended or adjusted under 35 U.S.C. 154(b) by 285 days.

(21) Appl. No.: 11/042,847

(22) Filed: Jan. 25, 2005

(65) Prior Publication Data

US 2006/0166790 A1 Jul. 27, 2006

(51) Int. Cl.
*A63B 71/00* (2006.01)

(52) U.S. Cl. ..... 482/1; 482/3; 482/8; 482/9; 434/247

(58) Field of Classification Search ..... 482/1–9, 482/900–902; 434/247; 340/500, 573.1
See application file for complete search history.

(56) References Cited

U.S. PATENT DOCUMENTS 5,945,911 A * 8/1999 Healy et al. ..... 340/573.1
6,447,424 B1 * 9/2002 Ashby et al. ..... 482/8
7,097,588 B2 * 8/2006 Watterson et al. ..... 482/8

* cited by examiner

*Primary Examiner*—Glenn Richman
(74) *Attorney, Agent, or Firm*—Troxell Law Office, PLLC

(57) ABSTRACT

An electronic console with a system for indicating the motion power having one large indicating area with light color change and one setting/comparing area. Judging from the change of light color in the indicating area, the observer (operator himself and other related persons) can easily acquire the relevant information of the current dynamic status of this exercise apparatus or the current physical status of the operator. Meanwhile, in the setting mode, the user can define a specific light color of the LED in this setting/comparing area to make a simple visual comparison with the light color in the indicating area to judge whether the current exercise or physical status of the user corresponds to that of the "setting color".

4 Claims, 1 Drawing Sheet

ELECTRONIC CONSOLE WITH A SYSTEM FOR INDICATING THE MOTION POWER

BACKGROUND OF THE INVENTION

1. Fields of the Invention

The invention relates to an electronic console with a system for indicating the motion power, and more particularly, to a specific electronic console which mainly employs more than one group of lighting areas to enable the observer in a simplest way to acquire the current exercise status and physical status of the operator. Those lighting areas can give out diverse lighting colors and provide the operator with optimal instant reference/comparison information in taking physical exercise or undergoing a training course.

2. Description of the Prior Art

The so-called electronic console here means particularly a type of a gauge that is installed in one exercise apparatus (such as treadmill, spinner bike). It consists of a circuit board with a microprocessor, physical status monitoring units (such as heartbeat monitoring units) and electronic circuits in connection with a main exercise apparatus to detect its dynamic status (dynamic information, such as rotating speed, time, exercise quantity and exercise resistance). Therefore, the user can manipulate the operation of this exercise apparatus with a power control button, parameter setting buttons and other control buttons. Also, the user can read the equipment's operation status and operator's physical status which are indicated on the console to acquire information about his current exercise and physical status.

In a word, with the conventional basic design of electronic console, the observers (including the operator, the trainer or the health attendant nearby) can only acquire the current exercise and physical status of the operator by approaching to the equipment and reading the indicating parameter items on the console carefully. However, this brings the operators much inconvenience.

SUMMARY OF THE INVENTION

Therefore, through the above mentioned consideration, the inventor assumes, if a system having more than one group optical indicating units which indicates and differentiates the different exercise statuses of the operators by means of different lighting colors, can be added to this electronic console, the observer is easily able to acquire and judge the current exercise and physical status of the operator at first glance. Therefore, it is fairly convenient for the observers since they don't need to approach the electronic console intentionally. First and foremost, it can remind the operator instantly to avoid the unexpected exercise or physical status (for example, the exercise status is too intense or inadequate, or the heart beats too fast, thereby putting the operator in danger). This is a main object of the invention.

Secondly, another object of the invention is to fully utilize the existing indicating areas of the display system. Furthermore, an extra basic setting/comparing area is designed for the operator, the trainer or the health attendant to set in advance a specific lighting color according to the body condition of the operator (such as older, sex, healthy condition and so on). Therefore, when the indicating lighting color in the monitoring area corresponds to the specific setting color, it means that the exercise or physical status of this operator corresponds to that of the setting color. The possible excessive or inadequate exercise intensity will be effectively avoided and, therefore, the expected effect of exercise and training can be achieved. Particularly, when the setting and the indicating color are different, the operator will be effectively reminded to take proper measure (for example, increase or reduce the intensity, or immediately stop the exercise).

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

In prior to the description of the working procedure of the invention, exercise status and physical status of the operator will be firstly defined as follows:

For the exercise apparatuses, the so-called exercise status of the operator means the power which is exerted by himself on the exercise apparatus. Briefly speaking, take the rotating speed for example, when we do not take the resistance into consideration, the higher the rotating speed in a standard time is, the more is the input power from the operator to the exercise apparatus and vice verse.

Secondly, the so-called physical status of the operator is based on the instant measuring data of the physical status by using a monitoring unit which is electrically connected to the operator's body. For example, through a heartbeat monitoring unit connected to the electronic console, the change of heartbeat value of the operator can be detected any time during the whole exercise session.

The basic components of the conventional electronic console must include a circuit board with a microprocessor, a physical status monitoring unit and electronic circuits in connection with the main exercise apparatus to detect its dynamic status. These belongs to prior art so that no further descriptions are given hereinafter.

Figure 1:
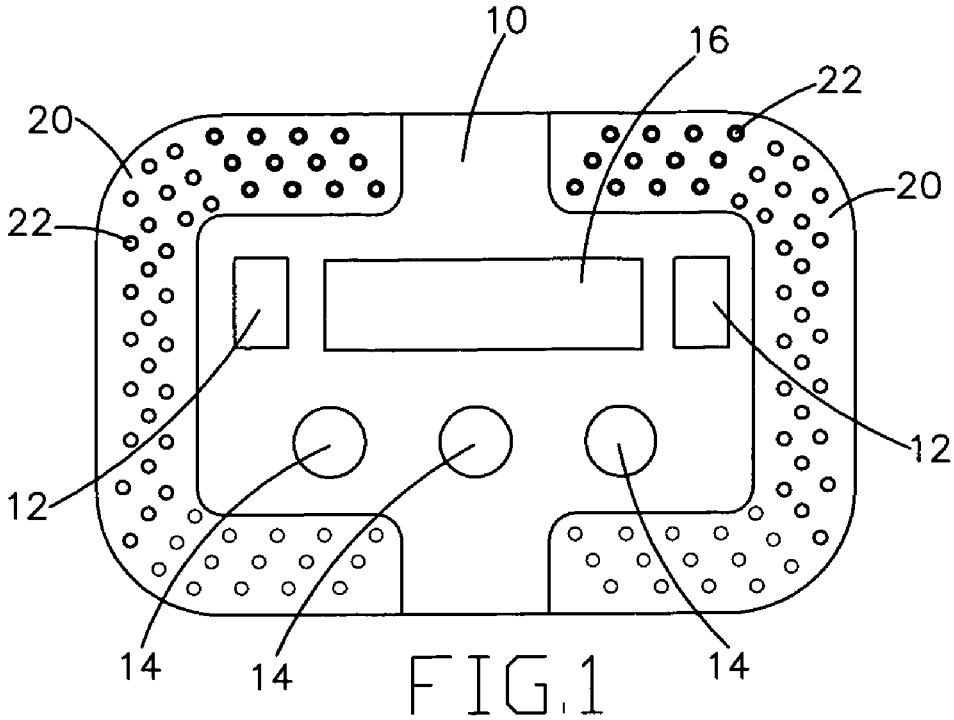
FIG. 1 is a schematic drawing of a preferred embodiment of the invention.

Firstly, referring to FIG. 1, a preferred embodiment of the invention is shown. The electronic console 10 includes a plurality of control buttons 12, parameter setting buttons 14 and, a display panel 16 through which the exercise apparatus (not shown in the drawing) will be controlled and manipulated.

On suitable spots of the electronic console 10, more than one set of large-area light changing indicating area 20 is mounted. A plurality of light-emitting diodes 22 with different colors is installed in the indicating area 20. The on/off function of the light-emitting diodes 22 is controlled by the instructions of the microprocessor (not shown in the drawing), thereby giving out different color light beams in large area. By use of light color change in the indicating area 20, the observer is able to acquire the current exercise status of the operator on the exercise apparatus or the current physical status of the operator without any difficulty.

The color change of the light-emitting diodes 22 occurs in accordance with the instructions of the microprocessor. The instructions from the microprocessor are based on the physical parameters or the motion power value parameters which are detected by the physical status monitoring units (not shown in the drawing) or the electronic circuits (not shown in the drawing).

Now we describe it with a simple example. When the operator's heartbeat value which is detected by a physical status monitoring unit is relatively low, the microprocessor can instruct the light-emitting diodes 22 to give out the cold color series lights (such as blue, green). But when this heartbeat value is mediate, they should give out neutral colors (such as yellow, orange). When the value is relatively high, they should give out warm color series lights (such as light red, heavy red) to remind the operator of taking proper measure.

Similarly, when the electronic circuits are employed to measure the motion power parameters, the change of light colors in the indicating area 20 can also be easily set in this way.

Therefore, according to the above unique design, the operator, trainer or the health attendant can easily judge the current exercise status or the physical status of the operator by one sight. Then, they can remind the operator if the exercise is too intense or inadequate for taking corresponding measure in time. Accordingly, not only can the optimal exercise effect be achieved, but also some dangerous situations (such as the too intense heartbeat) which may occur unconsciously can be effectively avoided.

Of course, as we all know, all kinds of expected light colors can be created by correspondingly mixing the three original light colors. This design also employs this basic principle to control the change of light color and the application does not show any delay.

Because the microprocessor program design does not fall to the study scope of the invention, no further descriptions thereto are given hereinafter.

Figure 2:
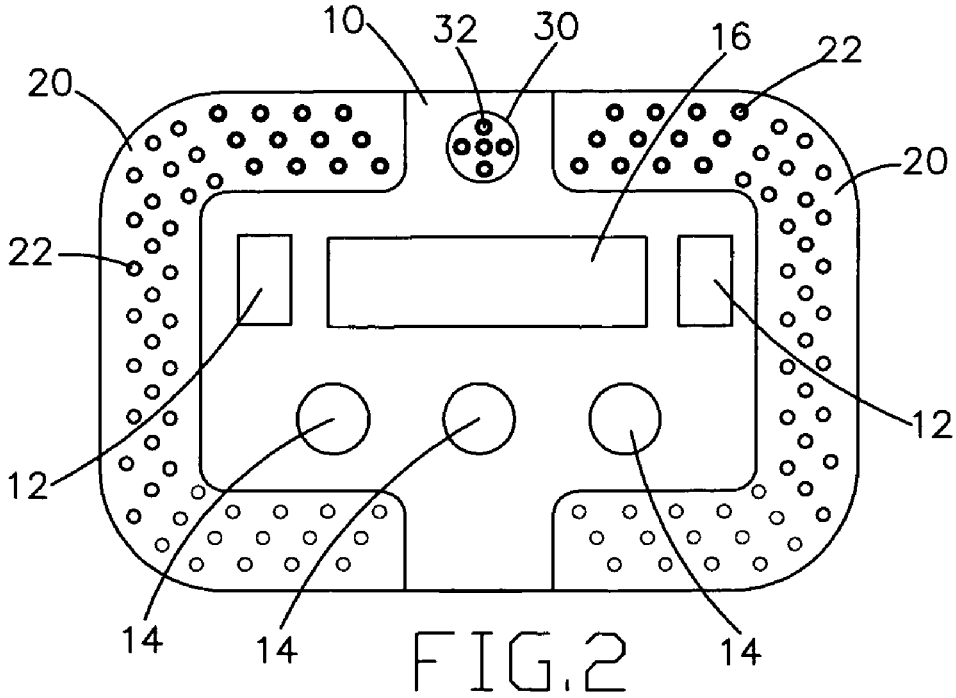
FIG. 2 is a schematic drawing of another preferred embodiment of the invention.

Furthermore, the embodiment as shown in FIG. 2 is designed according to the same principle. A setting/comparing area 30 can be added to the electronic console 10 in this embodiment. The setting/comparing area 30 also consists of several light-emitting diodes 32 with different colors. The on/off function of the light-emitting diodes 32 is also controlled by the pre-defined instructions from microprocessor to show different light colors in specific areas.

In prior to the operation of the exercise apparatus, the operator, trainer or health attendant himself can use the parameter setting button 14 to set the light-emitting diodes 32 in the setting/comparing area 30 to give out a specific light color. This specific light color is the so-called "setting color". This "setting color" enables the operator to make a simple visual comparison with the light color in the indicating area after starting the exercise. In this case, the observer can judge easily whether the current exercise or physical status of the operator corresponds to the status represented by the "setting color". Therefore, the too intense or inadequate exercise can be avoided effectively and the exercise or body-hardening effect can be achieved. Particularly, when the two illuminating colors do not match, this system can remind the operator immediately and effectively to take proper measure (increase or reduce the intensity of exercise or stop it).

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An electronic console with a system for indicating motion power, comprising:

a circuit board with a microprocessor;

physical status monitoring units;

electronic circuits connected with a main exercise apparatus to detect the dynamic status thereof;

a plurality of control buttons;

a plurality of parameter setting buttons;

a display panel;

at least one set of indicating areas disposed on the electronic console, wherein a plurality of light-emitting diodes are provided in the indicating area, the light-emitting diodes in the indicating area varying in color; and a setting/comparing area having a plurality of light-emitting diodes on the electronic console, the light emitting diodes in the setting/comparing varying in color, wherein the microprocessor is configured to control illumination of the light-emitting diodes, the microprocessor being further programmed to control the light-emitting diodes in the setting/comparing to provide a visual comparison with the color of the plurality of light emitting diodes in the indicating area, the light-emitting diodes in the setting/comparing area being selectively variable in color with the color of the light-emitting diodes in the setting/comparing area being selected to correspond to at least one physical trait of an exercising user, wherein a matching of the color of the light-emitting diodes in the setting/comparing area with the color of the light-emitting diodes in the indicating area indicates the achievement of an exercise threshold, wherein the indicating areas substantially surround the control buttons, parameter setting buttons, and display panel so that the plurality of light emitting diodes are positioned to indicate to an observer a physical parameter or a motion power value of the exercising user.

2. The electronic console with a system for indicating motion power as claimed in claim 1, wherein the microprocessor is configured to change the color of the light-emitting diodes based upon the physical parameters or the motion power value detected by the physical status monitoring units or the electronic circuits.

3. The electronic console with a system for indicating-motion power as claimed in claim 1, wherein the at least one physical trait of the exercising user is one or more traits selected from the group consisting of age, sex, health and fitness level.

4. The electronic console with a system for indicating-motion power as claimed in claim 1, wherein the exercise threshold is excessive exercise intensity or inadequate exercise intensity.

* * * * *